US006186250B1

(12) United States Patent
Estes

(10) Patent No.: US 6,186,250 B1
(45) Date of Patent: Feb. 13, 2001

(54) SHARP GAGE FOR MILL TOOTH ROCKBITS

(75) Inventor: Roy Estes, Fort Worth, TX (US)

(73) Assignee: Rock Bit International, Inc., Fort Worth, TX (US)

( * ) Notice: Under 35 U.S.C. 154(b), the term of this patent shall be extended for 0 days.

(21) Appl. No.: 09/282,951

(22) Filed: Apr. 1, 1999

(51) Int. Cl.[7] ..... E21B 10/50; E21B 10/16
(52) U.S. Cl. ..... 175/374; 175/426
(58) Field of Search ..... 175/374, 426

(56) References Cited

U.S. PATENT DOCUMENTS

| | | | | |
|---|---|---|---|---|
| 4,726,432 | * | 2/1988 | Scott et al. | 175/375 |
| 5,131,480 | | 7/1992 | Lockstedt et al. | 175/374 |
| 5,145,016 | | 9/1992 | Estes | 175/331 |
| 5,152,194 | * | 10/1992 | Keshavan et al. | 76/108.2 |
| 5,197,555 | | 3/1993 | Estes | 175/431 |
| 5,351,769 | * | 10/1994 | Scott et al. | 175/374 |
| 5,579,856 | * | 12/1996 | Bird | 175/375 |
| 5,732,783 | * | 3/1998 | Truax et al. | 175/374 |
| 5,868,213 | * | 2/1999 | Cisneros et al. | 175/331 |
| 5,921,330 | * | 7/1999 | Sue et al. | 175/374 |

OTHER PUBLICATIONS

*Hughes Christensen GT Technology*, pp. 20595–20596, The Challenge.

* cited by examiner

*Primary Examiner*—Hoang Dang
(74) *Attorney, Agent, or Firm*—Felsman, Bradley, Vaden, Gunter & Dillon, LLP

(57) ABSTRACT

A design for a gage tooth of the milled tooth variety is provided. The gage facing surface of each tooth is shaped so that only a narrow surface of each tooth contacts the borehole wall. Adjacent areas on each tooth slope away from the wall. The narrow gage facing surfaces, the sloping areas, and other areas are all covered with a suitable hard metal facing material.

9 Claims, 3 Drawing Sheets

SHARP GAGE FOR MILL TOOTH ROCKBITS

BACKGROUND OF THE DISCLOSURE

The present disclosure is directed to improved gage cutting teeth on milled teeth rolling cone rockbits. It has been common to plate over with a hard metal outer layer on a milled steel tooth on a cone. A representative currently used row of teeth, which extend to the gage configuration is shown in FIG. 5 of U.S. Pat. No. 5,131,480. The above mentioned patent describes certain of the difficulties in cutting to gage diameter with a broad, flat, gage positioned surface. Drawbacks of this sort have been acknowledged recently in a Hughes Christensen GT Technology Bulletin (date unspecified). The drawbacks in that bulletin of Hughes are directed primarily to tungsten carbide inserts (TCI hereinafter) in a rockbit. While that article is directed to TCI technology, the problem remains substantially the same for a cone in a drill bit which is made with milled teeth. At bottom, the problem simply is that a large flat area on the gage cutting surface cuts inefficiently. One attempt to solve that is set forth in U.S. Pat. No. 5,131,480. That reference teaches the advent of a partial covering of hard metal. It is located at the normal gage cutting surface. It is clad to the milled teeth of the cutter. By placing it at that location, this reduced the contact area existing between the rolling cone cutter and the surrounding borehole wall. FIG. 4 of the '480 patent shows a partial coating of hard metal material. This approach reduces the area of contact between the tooth as a whole and the borehole wall. It is, however, mechanically limited in that one edge of the hard cutting surface is exposed and therefore not supported. If the area of the partial hard facing is made narrow and therefore sharper, the hard facing material has a reduced bonding area holding it to the milled tooth and it is more likely to break off as a result of a planar stress fracture which chips off that piece of coating.

By contrast, the present disclosure sets forth a novel design for a gage tooth of the milled tooth variety. This is a structure which cuts better because it has a reduced or minimum contact area with the borehole wall. Yet, the extra hard metal surface is made stronger and bonded better because greater strength is achieved in the connective bond (a planar area). The gage facing surface of each tooth for the whole row of teeth on the cutter, is shaped so that only a narrow surface of each tooth confronts and thereby contacts the borehole wall. Adjacent areas on each tooth slope away from the wall. The narrow gage facing surfaces, these sloping areas and other areas are commonly covered with a suitable hard metal facing material. By providing a complete coverage over the gage facing areas, strength of the hard facing material is increased. Bonding of the hard facing material to the underlying milled tooth body is improved. The narrow cutting surfaces are more efficient and are less likely to fail. The narrow cutting edge concentrates the cutting force through a more narrow area and resulting in more efficient cutting. More efficient cutting in the gage area helps increase the overall rate of penetration resulting in lower cost for each foot drilled. More efficient cutting in the gage area can also result in an increase of total depth drilled reducing costs even more.

More efficient cutting in the gage area also makes a bit more suitable for directional drilling on mud motors.

BRIEF DESCRIPTION OF THE DRAWINGS

So that the manner in which the above recited features, advantages and objects of the present invention are attained can be understood in detail, more particular description of the invention, briefly summarized above, may be had by reference to the embodiments thereof which are illustrated in the appended drawings.

It is to be noted, however, that the appended drawings illustrate only typical embodiments of the invention and are therefore not to be considered limiting of its scope, for the invention may admit to other equally effective embodiments.

DETAILED DESCRIPTION OF THE PREFERRED EMBODIMENT

The present disclosure is concerned with tricone drill bits. It is concerned with those drill bits which have milled teeth formed in a row of cutting teeth. A milled tooth has a unitary construction so that there is no seam or interface where the tooth joins to the cone body. The tooth is formed from the body and in that sense, the milled tooth is integral to the cone body. Further, a whole row of milled teeth is customarily formed so that the teeth encircle the body providing the desired number of milled teeth.

Figure 1:
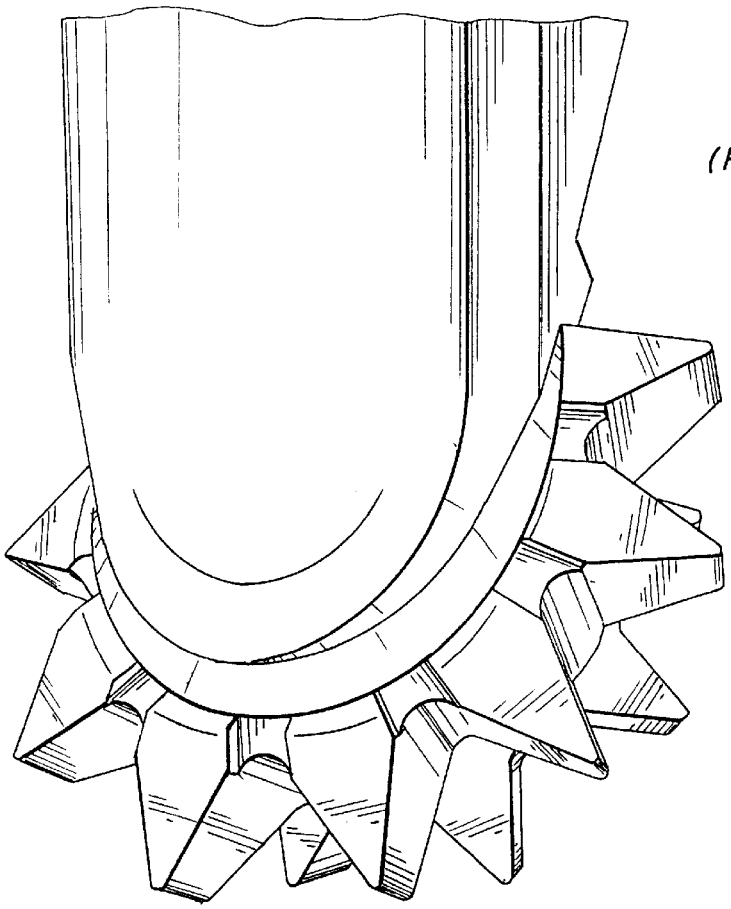
FIG. 1 (PRIOR ART)
FIG. 1 is a prior art milled tooth drill bit showing a common gage cutting configuration.
Figure 2:
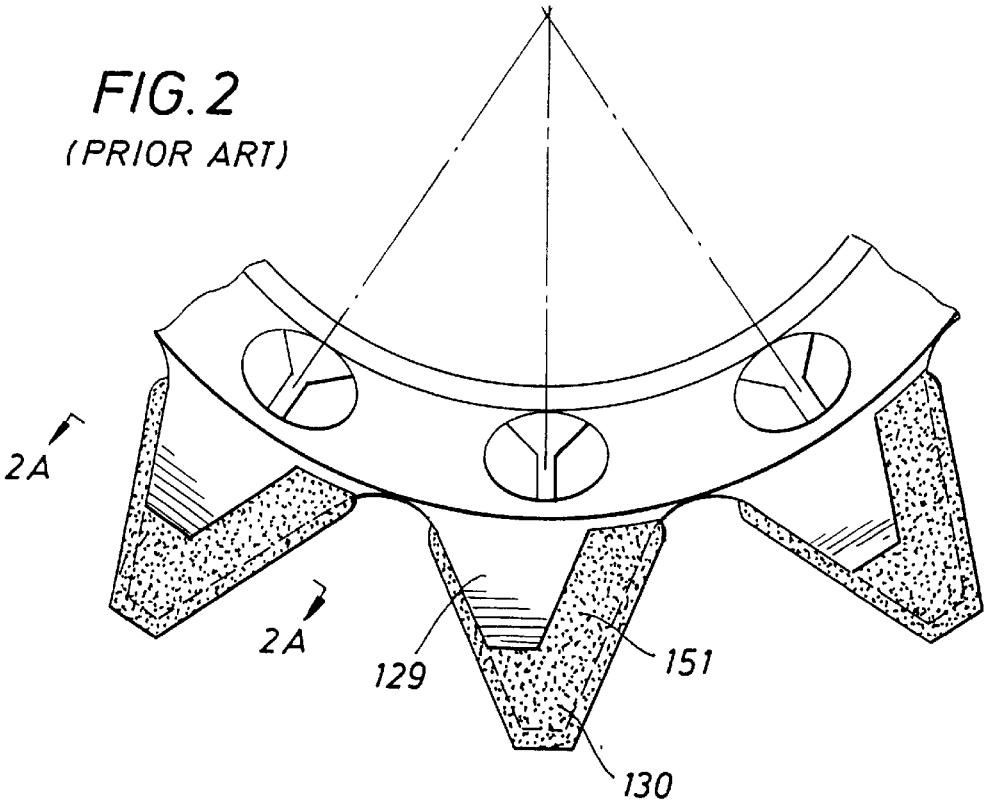
FIG. 2 (PRIOR ART)
FIG. 2 is another prior art gage cutting structure showing partial cladding on the milled teeth.

FIGS. 1 and 2 together represent different milled teeth constructions that have been known heretofore. FIG. 2 is derived from previously issued patent '480 just mentioned above. That patent disclosure shows the gage tooth 151. Hard metal covering 130 is placed over it. That extends to the gage diameter. This is located adjacent to an area 129 which is not covered. It is a part of the tooth 151. This tooth has a reduced cutting area surface comparable to the teeth shown in FIG. 1. That embodiment also is an earlier milled tooth cutter in accordance with the prior art.

Figure 2A:
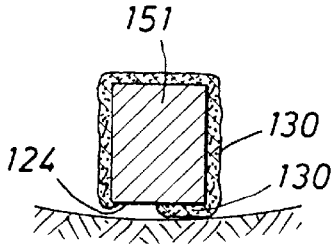
FIG. 2A (PRIOR ART)
FIG. 2A is a detailed sectional view of one tooth in FIG. 2 shown and from the prior art milled tooth and further showing cladding on the milled tooth so that it can be compared with comparable views of the milled tooth construction of the present disclosure.
Figure 3:
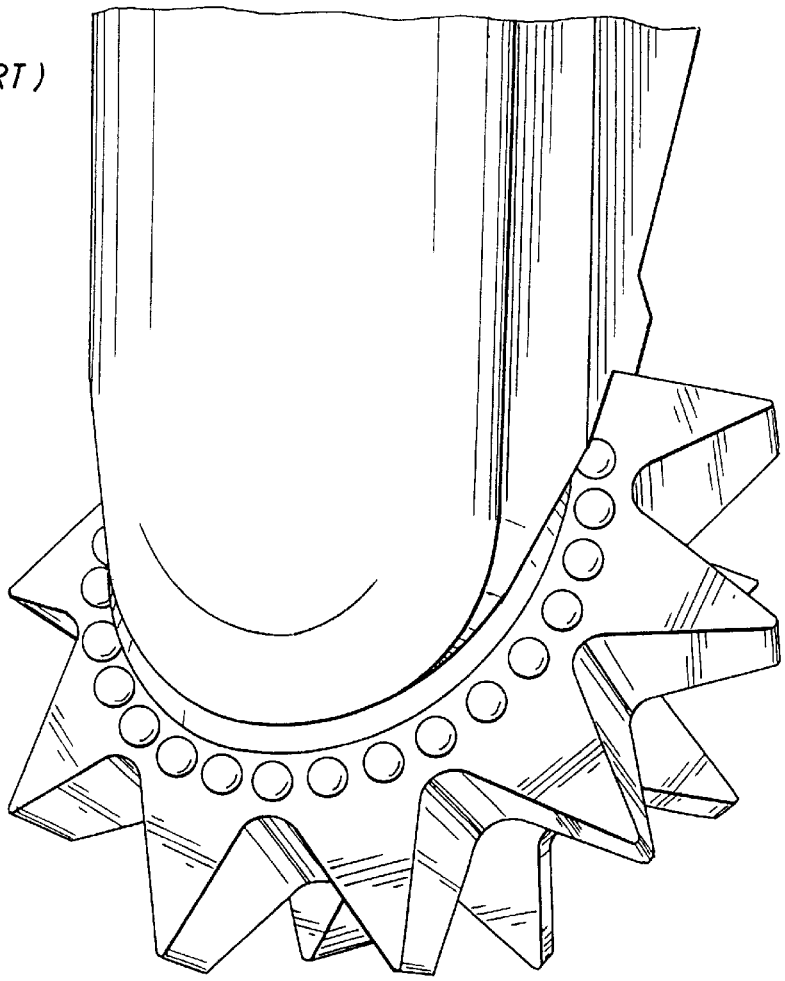
FIG. 3 (PRIOR ART)
FIG. 3 is a view similar to FIG. 1 showing another prior art milled tooth construction.

To explain the illustration of FIGS. 2 and 2A, noting that the reference numerals are the same as found in patent '480, the tooth is shown at an orthogonal view enabling the cladding to be shown where it has significant difficulties. Note that in FIG. 2A the sectional cut line is through the tooth where it is exposed for cutting. The area without cladding is identified again at the numeral 129. The area where the cladding occurs is identified at 130. The failure mode is commonly grinding away the hard metal facing over time. While grinding away might occur, another failure mode commonly is a fracture which breaks away a portion of that layer as illustrated in FIG. 2A. Eventually, it fails by wear or by catastrophic loss in one instant.

Figure 4A:
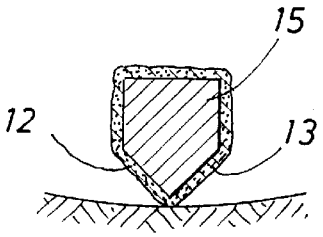
FIG. 4A is a sectional view through one tooth of the milled tooth cutter shown in FIG. 4.
Figure 4:
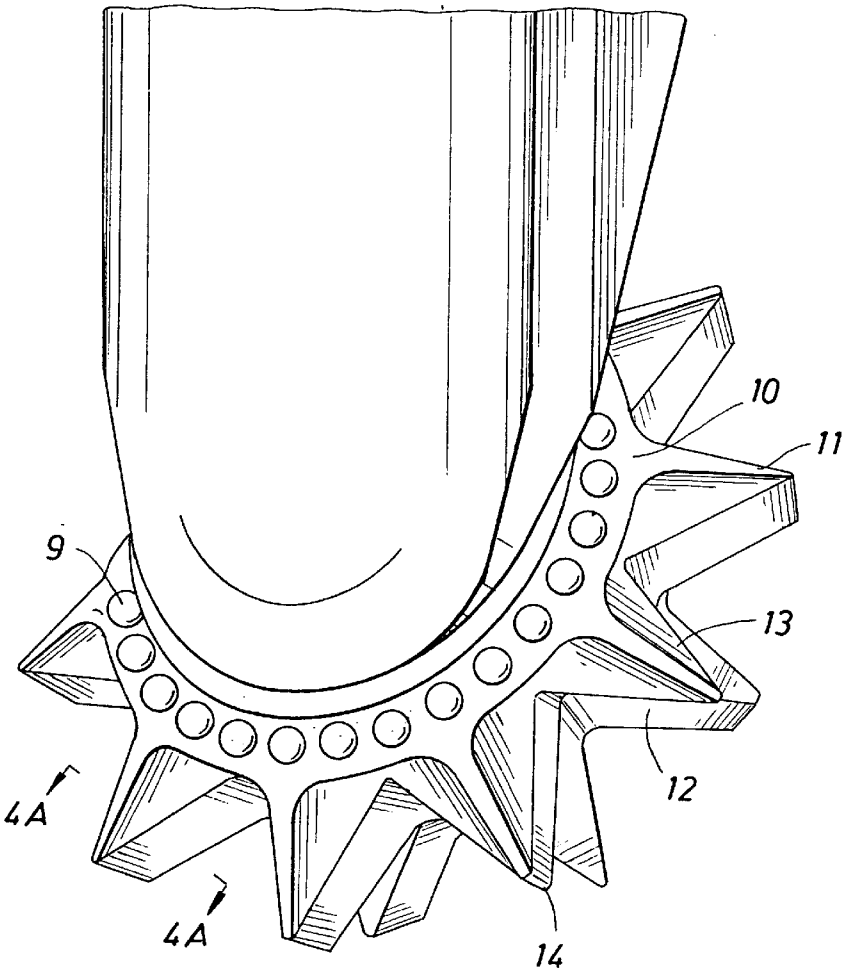
FIG. 4 is a view similar to FIGS. 1 and 3 showing a milled tooth construction in accordance with the teachings of the present disclosure.

By contrast, the present applicant has a clad tooth construction which is better illustrated in FIG. 4 of the drawings. Viewing FIG. 4 the milled tooth cone 10 has the gage teeth 11, and it is part of the journaled segment of a tricone milled tooth rotary rockbit. It will be appreciated that seals with the pressure compensation and lubrication system and the various bearing assemblies that are common to these drill bits are obscured because they 4re located out of sight on the interior. FIG. 4 shows a leading flank on a tooth. This is indicated by the numeral 12. The trailing flank or face is located on the opposite face, and the faces 12 and 13 come together at a point to define the outermost edge 14. FIGS. 4 and 4A considered together show a single tooth 11 which has a clearance area between the well borehole wall and the flank 12 on each tooth along with the trailing or back face 13. As shown in FIG. 4A, the hard facing layer 15 covers both faces or exposed flank sides of the tooth 11. This is a covering on the faces where most of the wear is encountered. This protects the exposed areas. They are protected during use by virtue of the hard facing material. Preferably, the hard facing material is a metal alloy binding together hard particles of tungsten carbide so that the entire layer is especially tough and yet able to withstand vibration. It is also very tough and therefore less brittle. It is able to withstand the grinding action that it encounters as it scrapes against the borehole wall. The layer 15 shown in FIG. 4A is applied to the tooth to a depth which is sufficiently thick to be effective and is relatively uniform in depth and hardness. It is applied to a depth ranging from about 40 mills up to about 90 mills in thickness. Preferably, all faces of the tooth 11 are covered.

Figure 5A:
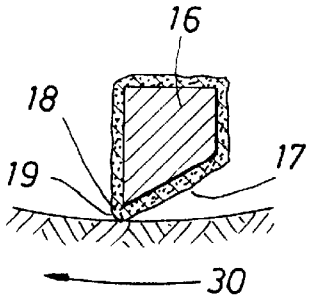
FIG. 5A is a view similar to FIG. 4A taken through one tooth of the embodiment shown in FIG. 5 and showing details of construction of the improved milled tooth of the present disclosure.
Figure 5:
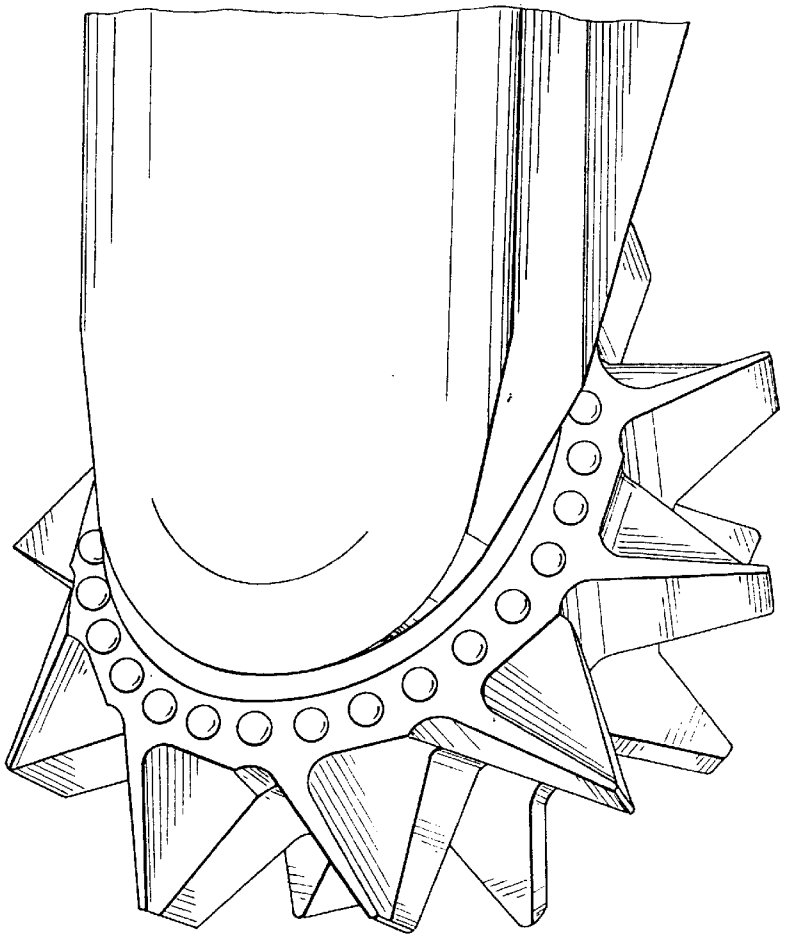
FIG. 5 is a view similar to FIGS. 1, 3, and 4 showing another embodiment of the present disclosure.

FIG. 5 of the drawings shows another embodiment, an alternate version of the preferred embodiment. It has teeth with a different shape. Rather than a "V" shape as exemplified in FIG. 4A, the tooth illustrated in FIG. 5 and 5A is wedge shaped. The leading flank 18 is substantially perpendicular to the wall. As the tooth engages formation it is moving downward with a minor lateral movement in the direction of the arrow 30. Therefore the tooth in 5A presents a sharper edge to the direction of lateral movement. This requires less energy for chip formation and the chips formed in a more open area are more readily washed away.

The hard facing 19 along the leading edge together with the rest of the hard facing layer 15 in the embodiment in FIG. 4A are applied to a suitable thickness. The thickness can vary, but it ranges between about 40 and 90 mills. If less than that, the hard facing may wear away too quickly, and abrasion failure modes may then be encountered. If desired, the layer can be made thicker so that it will have a longer life.

It will be observed that the teeth in FIGS. 4A and 5A present sharp edges which have narrow zones of contact faces. They are both coated, but it is to a relatively controlled thickness layer. Moreover, the coating is uniform so that the entire cutting region (almost a knife edge) and the adjacent flanking and tapered faces are likewise coated. This overall coating contrasts with the coating accomplished in the referenced '480 patent. In that particular disclosure, the coating material has a gap. It has a gap in order to reduce the area of hard metal contacting the hole wall. The configuration increases the possibility of hard metal failure by breaking off and as the hard metal area becomes narrower and more efficient for cutting formation, the possibility of failure by breaking off becomes more of a probability.

One advantage of this disclosure is that both faces at the V-shaped tooth (viewed in cross section) or chisel shaped construction of FIG. 5A are coated. All this hard facing construction provides a layer which is commonly in compression. Compression in this material is handled more readily than shear forces. They tend to break, creating a shear plane at the interface where the dissimilar materials are joined together. Effectively, that is a possibility for failure in the layer shown in FIG. 2A because it may break loose flush across the exposed face of the tooth.

The hard facing. of the present disclosure makes contact with the borehole wall with a relatively narrow track. It is something approaching a sharp line. Shear and compression forces acting on the tooth including forces acting on the coating material on the tooth are handled much more readily. The reduced area of the gage cutting tooth (a short straight line of relatively narrow width) cuts more efficiently. In some applications this narrow line of hard metal may wear away too fast. in those applications it is desirable to utilize a row of gage reaming inserts such as the row 9 shown in FIG. 4. That row is consistent with the teachings set forth in Applicant's earlier 5,145,016 patent.

While the foregoing is directed to the preferred embodiment, the scope thereof is determined by the claims which follow:

What is claimed is:

1. A milled tooth cone for a drill bit utlized to form a borehole comprising:

(a) a cone having an outside surface and also having a row of milled teeth wherein each of the teeth has, the cone defining an axis of rotation:

(i) a cutting surface of narrow dimension on the size facing the borehole's wall the surface at an angle to the axis of rotation, the surface defining first and second substantially parallel edges, (ii) a leading face extending to the first edge, and (iii) a trailing face extending to the second edge;

(b) a hard material cladding covering the milled teeth wherein the cladding fully covers the milled teeth.

2. The apparatus of claim 1 wherein said cladding is tungsten carbide in a metal alloy.

3. The apparatus of claim 2 wherein said cladding is at about 40 mills thick.

4. The apparatus of claim 2 wherein said cladding is about 40 mills up to 90 mills thick.

5. The apparatus of claim 4 wherein the milled tooth is V-shaped.

6. The apparatus of claim 4 wherein the milled tooth is wedged shaped.

7. The apparatus of claim 1 wherein said faces have a height equal to said cutting edge.

8. The apparatus of claim 7 wherein said cutting surface is replicated for the row of milled teeth.

9. The apparatus of claim 1 wherein said milled teeth are in a row, each of said teeth has a cutting surface, and said cladding covers said milled teeth to the root thereof.

* * * * *